US006732681B1

(12) United States Patent
Hendricks, Sr.

(10) Patent No.: US 6,732,681 B1
(45) Date of Patent: May 11, 2004

(54) MODULAR ENGINE COOLING SYSTEM WITH HYDRAULIC FAN DRIVE

(75) Inventor: Melvin A. Hendricks, Sr., Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/368,726

(22) Filed: Feb. 19, 2003

(51) Int. Cl.[7] ..... F01P 7/10
(52) U.S. Cl. ..... 123/41.49; 165/41; 180/68.4
(58) Field of Search ..... 123/41.12, 41.49, 123/41.51; 165/41; 180/68.4

(56) References Cited

U.S. PATENT DOCUMENTS 3,921,603 A * 11/1975 Bentz et al. ..... 123/41.49
4,200,146 A 4/1980 Olson
4,685,513 A 8/1987 Longhouse et al.
4,971,525 A * 11/1990 Nakayoshi et al. ..... 123/41.12
5,216,983 A 6/1993 Nilson
5,927,390 A 7/1999 Lehman
5,947,247 A 9/1999 Cummings, III
6,345,956 B1 2/2002 Lin
6,401,801 B1 * 6/2002 Dicke ..... 123/41.49
6,564,857 B1 * 5/2003 Zobel et al. ..... 123/41.49

* cited by examiner

*Primary Examiner*—Noah P. Kamen
(74) *Attorney, Agent, or Firm*—Jeffrey P. Calfa; Dennis Kelly Sullivan; Susan L. Lukasik

(57) ABSTRACT

A modular cooling plant for an internal combustion engine and accessory equipment installed on a motor vehicle provides a joint external frame supporting several heat exchangers and a centrally positioned centrifugal blower. The centrally positioned centrifugal blower is driven by a hydraulic motor through an impeller drive shaft, clutch and impeller. The hydraulic motor and dependent drive assembly are also mounted to the joint external frame to avoid risk of damage to the heat exchangers from the impeller should the vehicle engine shift.

8 Claims, 6 Drawing Sheets

MODULAR ENGINE COOLING SYSTEM WITH HYDRAULIC FAN DRIVE

BACKGROUND OF THE INVENTION

1. Field of the Invention

The present invention relates to cooling systems for internal combustion engines and more particularly to a compact cooling system for a truck engine which is relatively immune to damage from accidental shifts in engine position.

2. Description of the Problem

Some compact cooling systems for medium and heavy duty trucks have arranged a plurality of heat exchangers in a box like configuration. Individual heat exchangers are aligned with the direction of movement of the vehicle, with air drawn into the box from an end opened to the vehicle grill. A multiple-vane centrifugal blower is positioned in the box, rotating on an impeller which is centered in the box and axially aligned longitudinally with the vehicle. The heat exchangers at least partially surround the blower. The heat exchangers have been fixedly mounted to the frame of the vehicle.

The impeller has been driven by an impeller drive shaft which has in turn been driven by an impeller drive pulley attached to the vehicle's engine. No translation of the impeller drive pulley relative to the engine is possible in this arrangement. Thus, if the engine were to move relative to the heat exchanger, which can happen if an engine mount breaks and the engine moves relative to the frame of the vehicle, the impeller will move relative to the heat exchangers. Under these circumstances a collision between the impeller and one or more of the heat exchangers is possible with a high likelihood of expensive to repair damage to the heat exchanger.

SUMMARY OF THE INVENTION

According to the invention there is provided a vehicle having a modular compact engine cooling assembly. The modular compact engine cooling assembly comprises a multiple vane centrifugal blower centered in an arrangement of heat exchangers. An impeller for turning the multiple vane centrifugal blower is centered within the box and blower. An external frame supports the assembly from the frame of the vehicle. A drive motor for the impeller is mounted with respect to the external frame and coupled to the impeller for powering the impeller. The motor is preferably hydraulically pumped.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
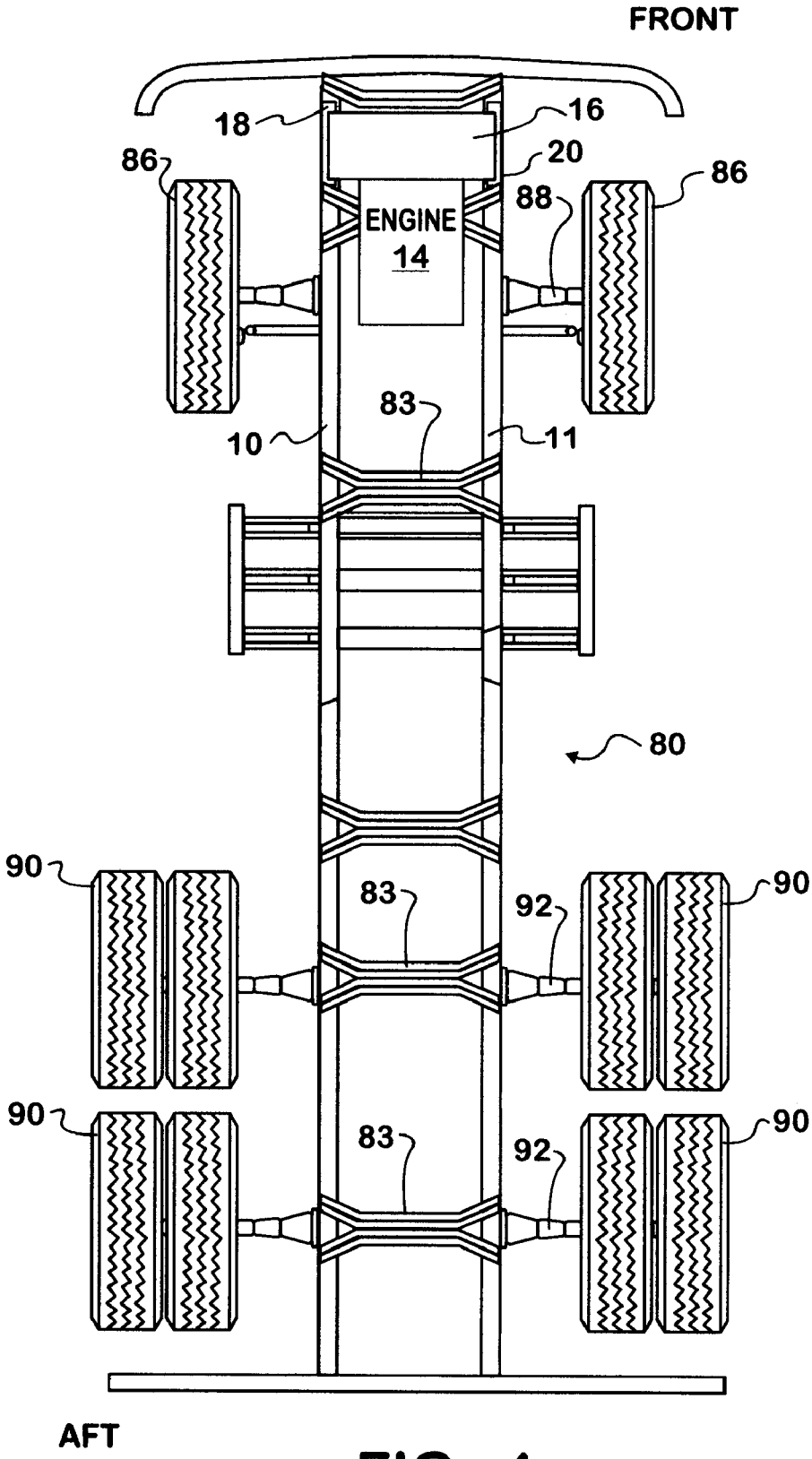
FIG. 1 is a top plan view of a vehicle chassis.

Referring now to the figures and in particular to FIG. 1 there is illustrated a vehicle frame 80 comprising left and right side rails 10 and 11 which extend in parallel for the longitudinal length of the frame. Rails 10 and 11 are held in parallel by a plurality of latitudinal cross beams 83 and are supported on front steering axle 88 and rear drive axles 92. Front wheels 86 and rear wheels 90 support the axles and allow the vehicle to move in directions parallel to the direction of elongation of the frame. Mounted over the front steering axle 88 between side rails 10 and 11 on a plurality of engine mounts (not shown) is a liquid cooled engine 14. Between engine 14 and the front of the vehicle frame 80 is modular cooling plant 16 supported from the side rails 10 and 11 by external frame rails 18 and 20, which are mounted on side rails 10 and 11, possibly vibrationally isolated from the side rails by rubber bushings (not shown). Engine coolant and other fluids circulate between liquid cooled engine 14 and the modular cooling plant 16.

Figure 2:
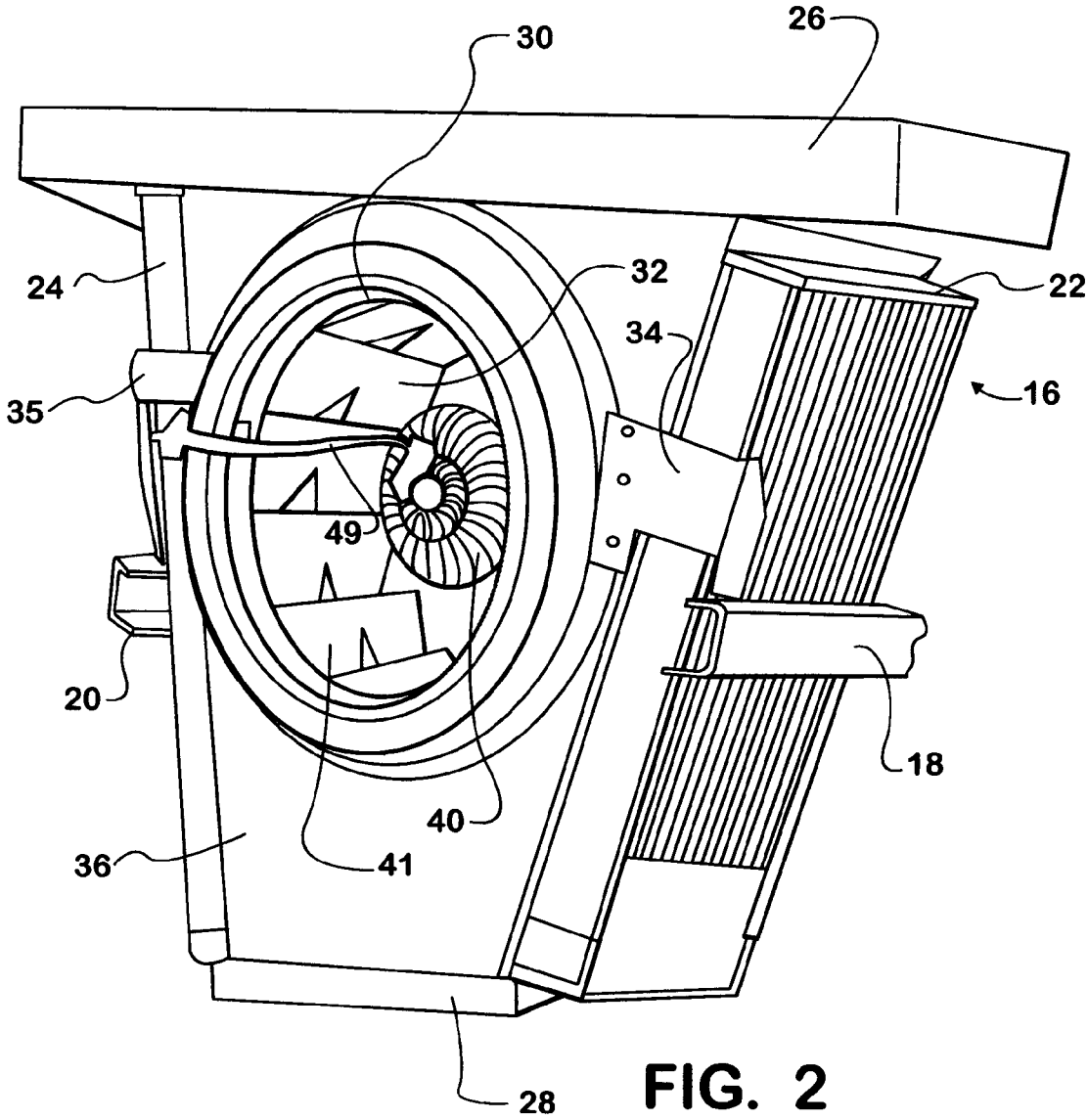
FIG. 2 is a perspective view of the modular cooling plant of the present invention.

Referring now to FIG. 2, modular cooling plant 16 is shown in perspective as viewed from the left (driver's side) front corner of the chassis. The heat exchangers 22, 24, 26 and 28, blower 32, fan impeller (shown in FIG. 4), impeller drive shaft (shown in FIG. 4) and hydraulic fan motor 40 are assembled as a modular package to be fixedly attached by frame rails 18 and 20 to the front portion of vehicle frame 80. Modular cooling plant 16 is located between the vehicle's grill and the front of engine 14. The axis of rotation of the impeller is parallel to the longitudinal axis of the vehicle. The blower 32 draws air through a vehicle grill or scoop and inlet 30 into a region surrounded on four sides by heat exchangers 22, 24, 26 and 28. Air is forced by blower 32 out through the sides of the enclosure formed by heat exchangers 22, 24, 26 and 28. Heat exchangers 22, 24, 26 and 28 may be connected to coolant circulation systems for the engine, air conditioning compressor, automatic transmission, etc.

The front of modular cooling plant 16 is partially closed by front panel 36. Air inlet 30 is defined by an opening through panel 36. Visible through the opening is a hydraulic motor 40 which drives the rotary squirrel cage 41 of multiple vane centrifugal compressor 32. Panel 36 is supported in place by connection to braces 35 and 34, which are mounted on external support rails 20 and 18, respectively.

Modular cooling plant 16 is supported between side rails 18 and 20, and comprises four heat exchangers 22, 24, 26 and 28. Heat exchangers 22, 24, 26 and 28 are arranged end to end in a trapezoidal shaped enclosure, with top heat exchanger 26 and bottom heat exchanger 28 forming the parallel sides of the enclosure and with side heat exchangers 22 and 24 being canted inwardly toward one another at the bottom of the enclosure. Inside of the enclosure formed by heat exchangers 22, 24, 26 and 28 is a multiple vane centrifugal blower 32 which is mounted for rotation in the cooling plant 16 as discussed below.

Figure 3:
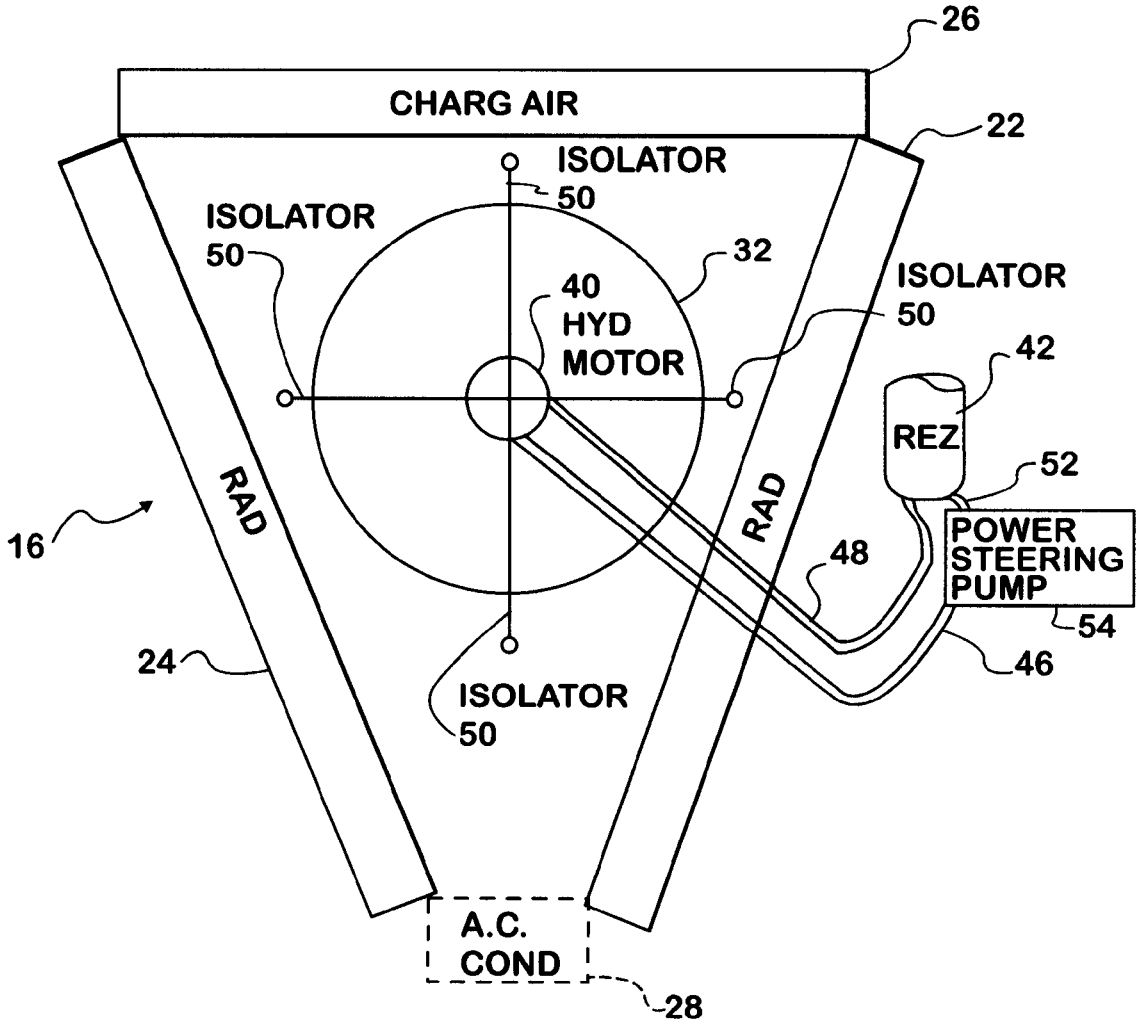
FIG. 3 is a schematic of the modular cooling plant.

Referring to FIG. 3, energy delivery to hydraulic motor 40 is schematically illustrated. Hydraulic motor 40 is located centered within heat exchangers 22, 24, 26 and 28 its mounting buffered by isolators to reduce vibration transmitted to the heat exchangers. Hydraulic motor 40 receives pressurized hydraulic fluid from power steering pump 54 through a conduit 46. Fluid is returned from hydraulic motor 40 by a conduit 48 to a power steering fluid reservoir 42, from which it is drawn for recirculation by pump 54 through tube 52.

Figure 4:
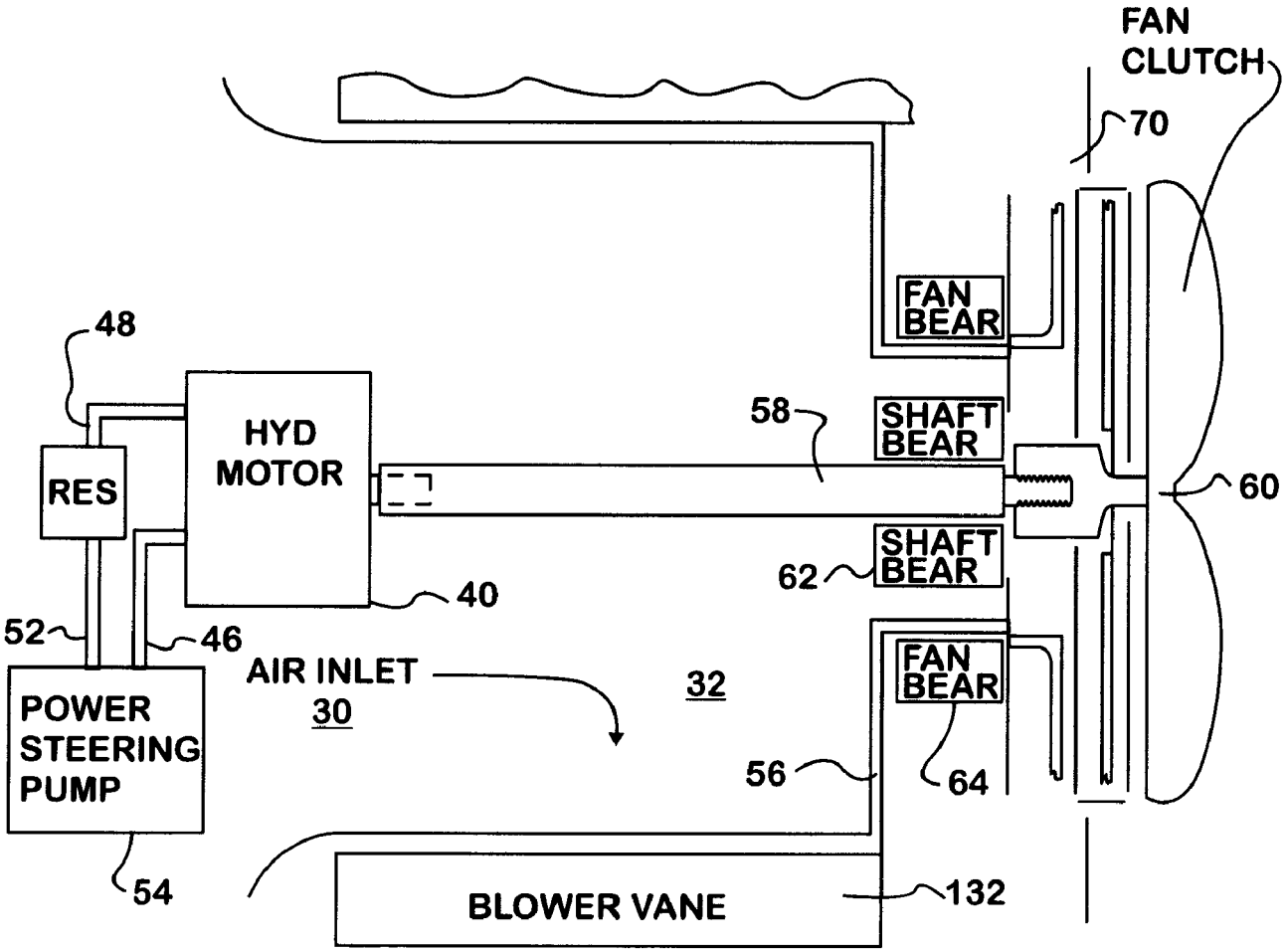
FIG. 4 is a top schematic of the modular cooling plant.

Referring to FIG. 4 energy transfer from hydraulic motor 40 to multiple-vane centrifugal blower 32 is depicted. Hydraulic motor 40, centered in air inlet 30, is directly coupled to and supported on an end of a rigid impeller drive shaft 58 located in the center of multiple-vane centrifugal blower 32. Drive shaft 58 rotates in a shaft bearing 62 and is connected into a fan clutch 60, which couples energization to impeller 56. Impeller 56 in turn rotates in a fan bearing 64. Blower vanes 132 are disposed around the radial impeller 56 to provide the multiple-vane centrifugal blower 32. Fan clutch 60 is mounted in a rear wall 70 of the modular cooling plant 16. Fan clutch 60 operates conventionally, allowing multiple-vane blower 32 to free wheel when the rate of air flow forced through inlet 30 outstrips the rate at which impeller drive shaft 58 would drive the blower.

Figure 5:
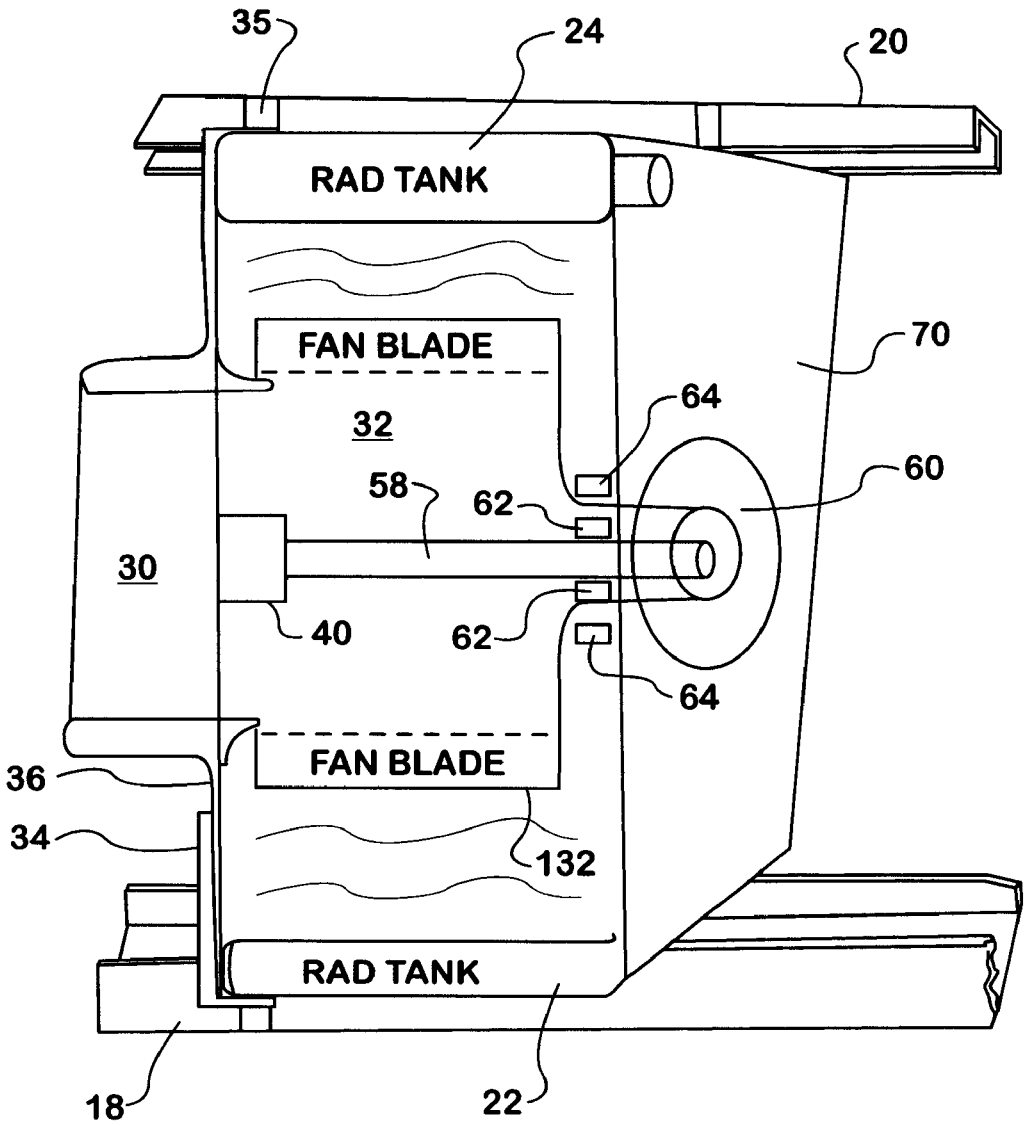
FIG. 5 is an section view of the modular cooling plant.

As seen if FIG. 5, rear wall 70 is mounted between and to side frame rails 18 and 20 making the wall part of the external frame serving to brace the heat exchangers 22, 24, 26 and 28. Heat exchangers 22, 24, 26 and 28 and front wall 36 are further braced on rails 18 and 20 by braces 34 and 35.

Figure 6:
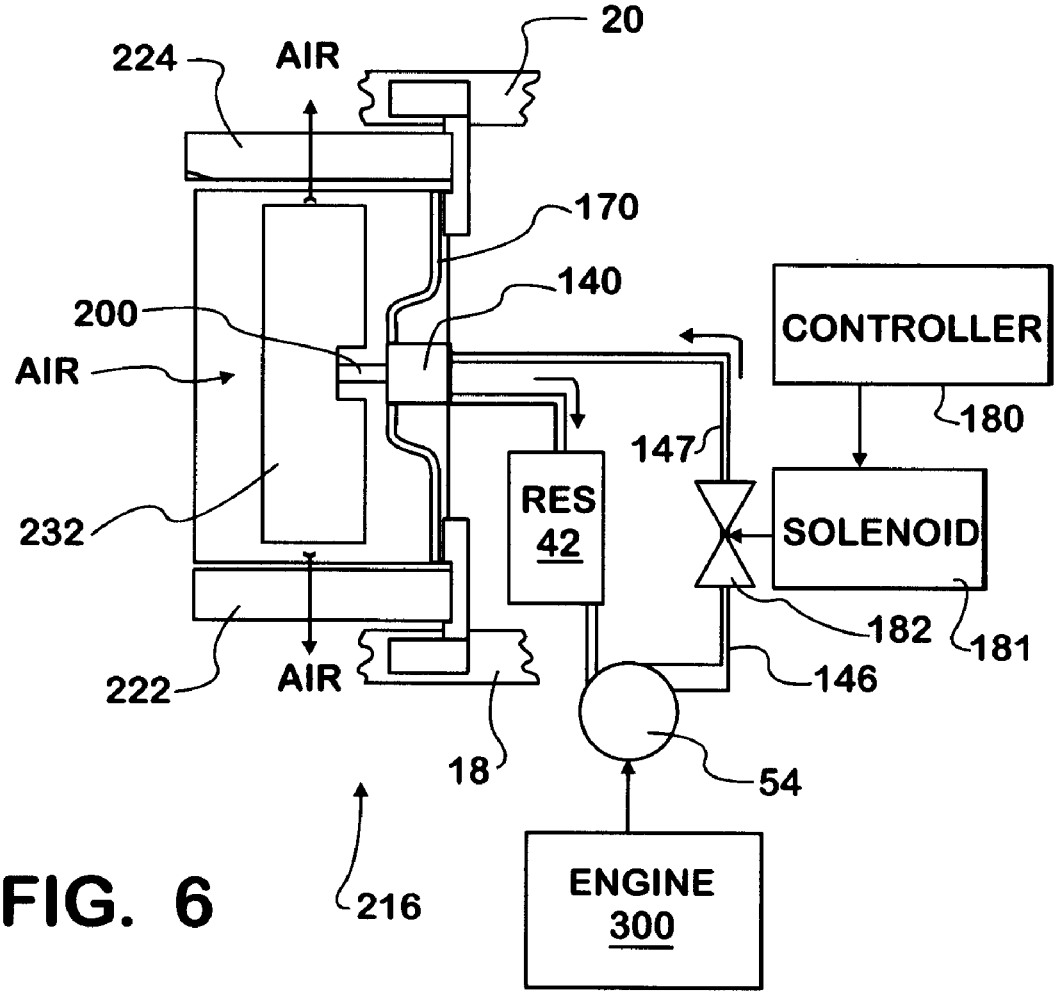
FIG. 6 is a schematic of an alternative hydraulic motor control system used with the modular cooling plant.

Referring now to FIG. 6 a control schematic for an alternative embodiment of the invention is described. A centrifugal blower 232 is directly driven on a shaft 200 from hydraulic motor 140 which is mounted in rear wall 170 of a modular cooling plant 216. Modular cooling plant 216 comprises a plurality of heat exchangers, including heat exchangers 222 and 224, arranged radially around centrifugal blower 232. Hydraulic motor 40 is energized by pressurized hydraulic fluid from a reservoir 42 which is pumped to the motor by pump 54 through conduit 146, valve 182 and conduit 147. Valve 182 may be used to vary the flow of fluid under the control of a solenoid 181 which is activated by a solenoid controller 180. Controller 180 may be a implemented by a thermostat or by some sort of engine controller running a more sophisticated cooling regimen. Controller 180 allows speed control of blower 232 to be implemented. Pump 54 is driven by engine 300, typically using drive belts between the engine crankshaft and a drive pulley attached to the pump (not shown).

The present invention eliminates the possibility of translational movement of the impeller relative to the heat exchangers by mounting both heat exchangers and the impeller to the same supporting sub frame. The use of hydraulic drive for the impeller allows use of simple rigid impeller drive shaft.

While the invention is shown in only one of its forms, it is not thus limited but is susceptible to various changes and modifications without departing from the spirit and scope of the invention.

What is claimed is:

1. A modular engine cooling assembly comprising:

a multiple vane centrifugal blower;

an impeller for turning the multiple vane centrifugal blower;

a radiator assembly disposed radially around the multiple vane centrifugal blower;

an external frame comprising first and second side rails and front and back walls for supporting the radiator assembly from a vehicle chassis; and a motor coupled to the impeller for driving the impeller, the motor being attached to and supported on the rear wall of the external frame.

2. A modular engine cooling assembly as set forth in claim 1, wherein the motor is hydraulically pumped.

3. A modular engine cooling assembly as set forth in claim 2, further comprising:

an impeller drive shaft coupling the motor to the impeller.

4. A modular engine cooling assembly as set forth in claim 3, the radiator assembly further comprising:

four heat exchangers arranged end to end in a trapezoidal perimeter arrangement around the multiple vane centrifugal blower, a top and a bottom heat exchanger being parallel to one another and the two side heat exchangers being closer to one another adjacent the bottom heat exchanger than they are adjacent the top heat exchanger.

5. A modular engine cooling assembly as set forth in claim 4, further comprising:

a pair of panels disposed along opposite open edges of the four rectangular heat exchangers, the pair of panels with the four rectangular heat exchangers substantially enclosing a volume including the multiple vane centrifugal blower;

an air intake through one of the panels, the center of the air intake being axially aligned with the impeller drive shaft; and a brace connected between the external frame and the motor.

6. A vehicle comprising:

a chassis elongated from front to rear of the vehicle;

a liquid cooled engine supported on the chassis;

a cooling plant supported from the chassis forward from the liquid cooled engine; and the cooling plant comprising an external frame mounted to the chassis forward from the liquid cooled engine, the external frame including first and second side rails supported in parallel to and from frame rails of the chassis, and front and back walls attached between the side rails of the external frame, a multiple vane, centrifugal blower and drive motor for the multiple vane, centrifugal blower, the drive motor being mounted to the rear wall of the external frame to drive the blower on an axis parallel to the direction of elongation of the chassis, and a radiator assembly mounted on the external frame and disposed radially around the multiple vane, centrifugal blower.

7. A vehicle as set forth in claim 6, further comprising:

a pump driven by the liquid cooled engine coupled by a fluid conduit to force hydraulic fluid through the hydraulic motor.

8. A vehicle as set forth in claim 7, further comprising:

a valve in the fluid conduit for varying the flow of hydraulic fluid from the pump to the hydraulic motor; and a controller for the valve.

* * * * *